US007234344B2

(12) United States Patent
Inagaki et al.

(10) Patent No.: US 7,234,344 B2
(45) Date of Patent: Jun. 26, 2007

(54) VANE PUMP AND FUEL VAPOR LEAKAGE CHECK MODULE HAVING THE SAME

(75) Inventors: Koichi Inagaki, Okazaki (JP); Yoshichika Yamada, Kuwana-gun (JP); Hitoshi Amano, Okazaki (JP)

(73) Assignee: DENSO Corporation (JP)

( * ) Notice: Subject to any disclaimer, the term of this patent is extended or adjusted under 35 U.S.C. 154(b) by 441 days.

(21) Appl. No.: 10/923,793

(22) Filed: Aug. 24, 2004

(65) Prior Publication Data

US 2005/0047937 A1 Mar. 3, 2005

(30) Foreign Application Priority Data

Aug. 25, 2003 (JP) ..... 2003-300161
May 24, 2004 (JP) ..... 2004-153527

(51) Int. Cl.
*G01M 19/00* (2006.01)
*F01C 1/00* (2006.01)
*F01C 19/10* (2006.01)

(52) U.S. Cl. ..... 73/118.1; 418/131; 418/134; 418/259

(58) Field of Classification Search ..... 73/118.1; 418/131, 133, 134, 152, 153, 259, 266–268
See application file for complete search history.

(56) References Cited

U.S. PATENT DOCUMENTS 2,466,623 A * 4/1949 Tucker et al. ..... 418/149
3,136,260 A * 6/1964 Eickmann ..... 418/173
3,498,233 A * 3/1970 Dillberg ..... 417/259
5,575,629 A * 11/1996 Olson et al. ..... 417/405
5,816,297 A * 10/1998 Olson et al. ..... 141/59
5,890,474 A 4/1999 Schnaibel et al.
7,036,359 B2 * 5/2006 Hayakawa et al. ..... 73/118.1
7,114,931 B2 * 10/2006 Wilk et al. ..... 418/259
2005/0022588 A1 * 2/2005 Hayakawa et al. ..... 73/118.1
2006/0191330 A1 * 8/2006 Hayakawa et al. ..... 73/118.1

FOREIGN PATENT DOCUMENTS

JP 03199686 A * 8/1991

* cited by examiner

*Primary Examiner*—Hezron Williams
*Assistant Examiner*—John Fitzgerald
(74) *Attorney, Agent, or Firm*—Nixon & Vanderhye PC

(57) ABSTRACT

A vane pump includes a motor arrangement, a rotor, a casing and bolts. The motor arrangement includes a mount. The rotor includes vanes and is rotated by the motor arrangement. The casing has opposed first and second end surfaces and makes flat surface contact with the mount at the second end surface thereof. The casing includes a pump chamber, receiving through holes and second end side recesses. The pump chamber receives the rotor. The receiving through holes penetrate through the casing. The second end side recesses are recessed in the second end surface of the casing. The second end side recesses are spaced away from the receiving through holes. Each bolt is received through a corresponding one of the receiving through holes of the casing, and each bolt is threadably engaged with the mount to connect the casing to the mount.

12 Claims, 7 Drawing Sheets

VANE PUMP AND FUEL VAPOR LEAKAGE CHECK MODULE HAVING THE SAME

CROSS REFERENCE TO RELATED APPLICATION

This application is based on and incorporates herein by reference Japanese Patent Application No. 2003-300161 filed on Aug. 25, 2003 and Japanese Patent Application No. 2004-153527 filed on May 24, 2004.

BACKGROUND OF THE INVENTION

1. Field of the Invention

The present invention relates generally to a vane pump, and specifically to a vane pump, which can be effectively used in, for example, a fuel vapor leakage check module that checks fuel vapor leakage.

2. Description of Related Art

A known vane pump compresses and discharges fluid by rotating a rotor, which includes vanes and is received in a pump chamber of a casing. Japanese Unexamined Patent Publication No. 10-90107, which corresponds to U.S. Pat. No. 5,890,474, discloses one such vane pump, which is used in a fuel vapor leakage check module that checks leakage of fuel vapor from a fuel tank and which depressurizes or pressurizes the interior of the fuel tank. In this type of vane pump, a pump flow rate is important since the pump flow rate has a significant influence on the performance of the fuel vapor leakage check module.

In one previously proposed vane pump, bolts are installed through a casing and are threadably engaged with a mount of a motor, so that the casing is securely connected to the mount by the bolts. The casing makes flat surface contact with the mount, and the casing and the mount are tightly connected together by the bolts. Thus, when a degree of flatness of a contact surface of the casing and a degree of flatness of a contact surface of the mount, which contacts the contact surface of the casing, are relatively low, it is difficult to achieve tight contact between the casing and the mount around the bolts. For example, such a difficulty may arise in the case where a protrusion is formed in a position, which is remote from the receiving through holes in the casing. In such a case, the connecting force, which is achieved by the bolts to connect between the casing and the mount, decreases, and thereby the motor can be easily vibrated relative to the casing during operation of the vane pump. When this happens, an accidental change in the pump flow rate of the vane pump could occur.

SUMMARY OF THE INVENTION

The present invention addresses the above disadvantages. Thus, it is an objective of the present invention to provide a vane pump, which limits an accidental change in a pump flow rate of the vane pump. It is another objective of the present invention to provide a fuel vapor leakage check module, which has such a vane pump.

To achieve the objectives of the present invention, there is provided a vane pump that includes a motor arrangement, a rotor, a casing and at least one male threaded screw member. The motor arrangement includes a mount. The rotor includes a plurality of vanes and is rotated by the motor arrangement. The casing has opposed first and second end surfaces and makes flat surface contact with the mount at the second end surface thereof. The casing includes a pump chamber, at least one receiving through hole and at least one second end side recess. The pump chamber receives the rotor. The at least one receiving through hole penetrates through the casing. The at least one second end side recess is recessed in the second end surface of the casing. The at least one second end side recess is spaced away from the at least one receiving through hole. Each of the at least one male threaded screw member is received through a corresponding one of the at least one receiving through hole of the casing, and each of the at least one male threaded screw member is threadably engaged with the mount to connect the casing to the mount.

To achieve the objectives of the present invention, there is also provided a vane pump that includes a rotor, a casing, a first end member, a second end member and a connecting means. The rotor includes a plurality of vanes. The casing has opposed first and second end surfaces and includes a pump chamber and at least one recess. The pump chamber rotatably receives the rotor. The at least one recess is recessed in at least one of the first and second end surfaces of the casing. The first end member covers the first end surface of the casing. The second end member covers the second end surface of the casing. The connecting means is for connecting the first end member, the casing and the second end member together and is for exerting a clamping force for clamping the casing between the first end member and the second end member. The connecting means is spaced away from the at least one recess.

To achieve the objectives of the present invention, there is further provided a fuel vapor leakage check module for checking leakage of fuel vapor from a fuel tank. The fuel vapor leakage check module includes a vane pump. The fuel vapor leakage check module checks leakage of fuel vapor from the fuel tank through depressurization or pressurization of an interior of the fuel tank by the vane pump. The vane pump includes a motor arrangement, a rotor, a casing and at least one male threaded screw member. The motor arrangement includes a mount. The rotor includes a plurality of vanes and is rotated by the motor arrangement. The casing has opposed first and second end surfaces and makes flat surface contact with the mount at the second end surface thereof. The casing includes a pump chamber, at least one receiving through hole and at least one second end side recess. The pump chamber receives the rotor. The at least one receiving through hole penetrates through the casing. The at least one second end side recess is recessed in the second end surface of the casing. The at least one second end side recess is spaced away from the at least one receiving through hole. Each of the at least one male threaded screw member is received through a corresponding one of the at least one receiving through hole of the casing, and each of the at least one male threaded screw member is threadably engaged with the mount to connect the casing to the mount.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

FIRST EMBODIMENT

A first embodiment will be described with reference to FIGS. 1 to 8.

Figure 2:
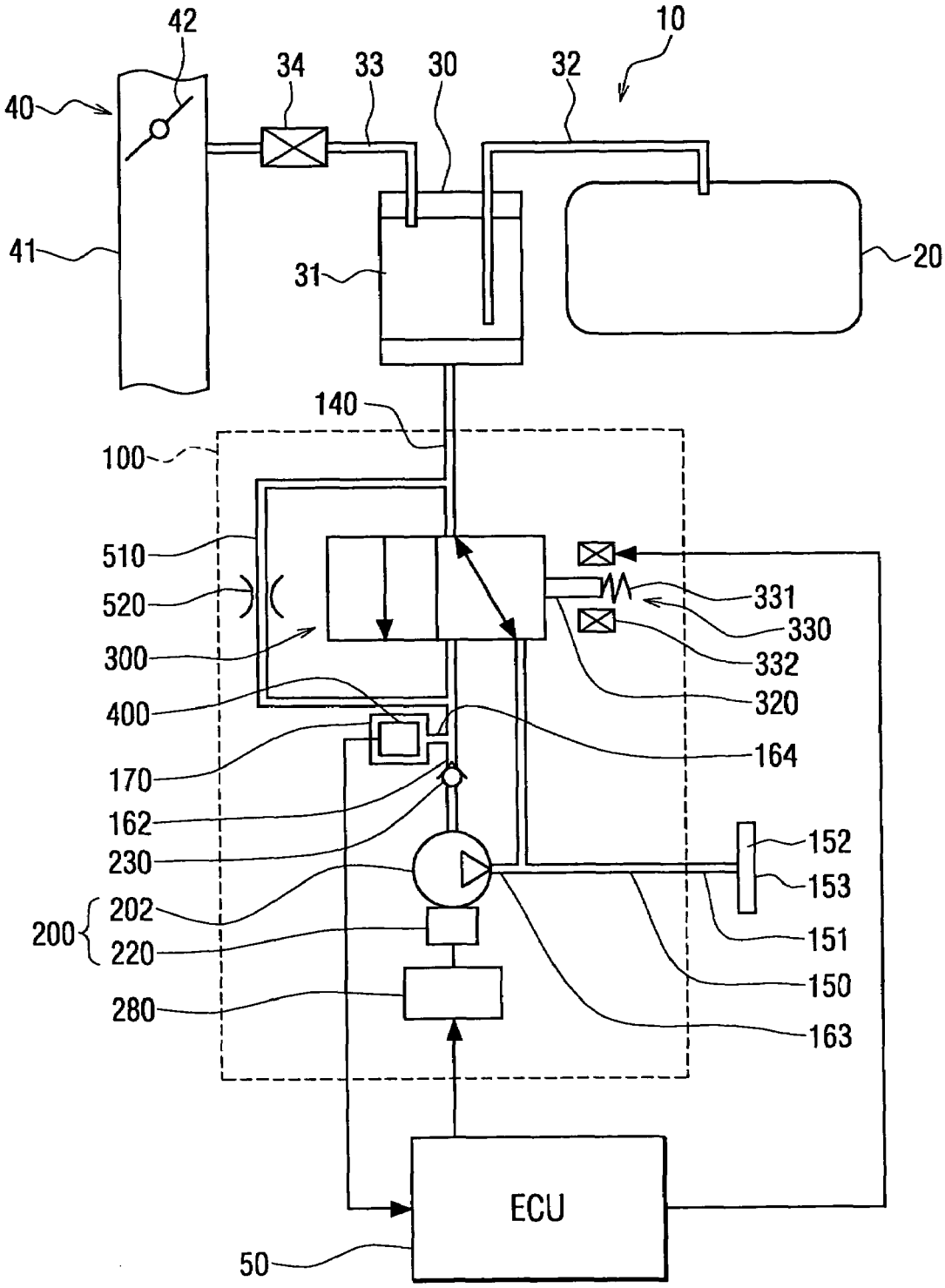
FIG. 2 is a schematic view of a check system in which a check module of the first embodiment is installed.

A fuel vapor leakage check system (hereinafter simply referred to as "check system") of a first embodiment, which includes a fuel vapor leakage check module (hereinafter simply referred to as "check module") is shown in FIG. 2.

The check system 10 includes the check module 100, a fuel tank 20, a canister 30, an air intake apparatus 40 and an ECU 50.

Figure 3:
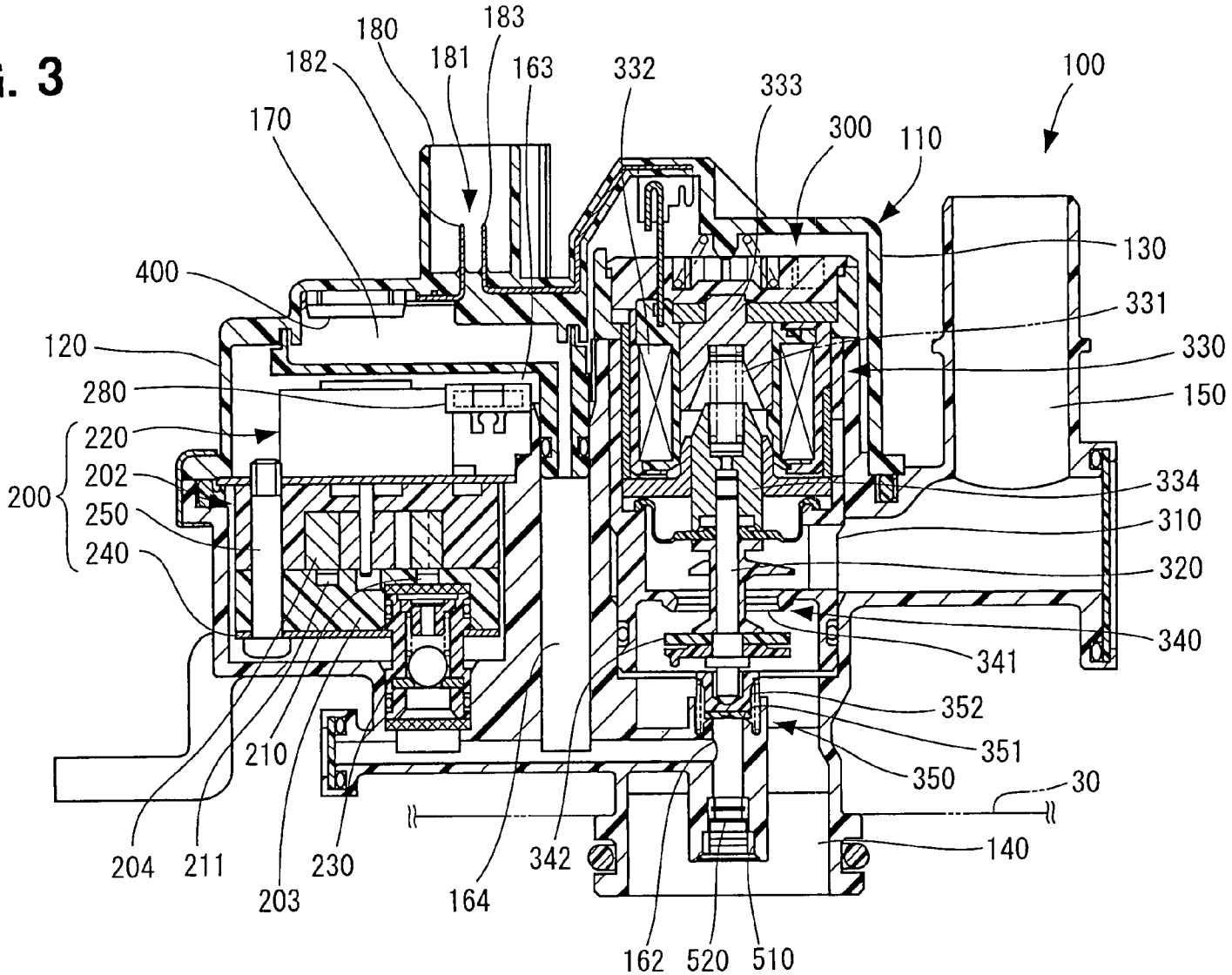
FIG. 3 is a cross sectional view of the check module of the first embodiment.

As shown in FIG. 3, the check module 100 includes a housing 110, a vane pump 200, a switching valve 300 and a pressure sensor 400.

The housing 110 includes a pump receiving portion 120 and a switching valve receiving portion 130. The pump receiving portion 120 receives the vane pump 200, and the switching valve receiving portion 130 receives the switching valve 300. The housing 110 further includes a canister port 140 and an atmosphere port 150. One end of the canister port 140 is connected to one end of the atmosphere port 150 through the switching valve 300. The other end of the canister port 140, which is opposite from the switching valve 300, is connected to the canister 30. The other end of the atmosphere port 150, which is opposite from the switching valve 300, is connected to one end of an atmosphere passage 151, as shown in FIG. 2. The other end of the atmosphere passage 151 has an open end 153, which is located on a side opposite from the check module 100 and is connected to an air filter 152. Thus, the other end of the atmosphere passage 151 is opened to the atmosphere on the side opposite from the check module 100.

As shown in FIG. 3, the housing 110 further includes a pump passage 162, an outlet passage 163, a pressure communicating passage 164, a sensor chamber 170 and an orifice passage 510. One end of the pump passage 162 is connected to an intake opening 210 of a pump arrangement 202 of the vane pump 200 through a check valve 230 of the pump arrangement 202. The other end of the pump passage 162, which is opposite from the check valve 230, is connected to the canister port 140 and also to the atmosphere port 150 through the switching valve 300. The outlet passage 163 connects between an outlet opening 211 of the pump arrangement 202 and the atmosphere port 150. One end of the pressure communicating passage 164 is connected to an intermediate portion of the pump passage 162, and the other end of the pressure communicating passage 164, which is opposite from the pump passage 162, is connected to the sensor chamber 170. The pressure sensor 400 is arranged in the sensor chamber 170. One end of the orifice passage 510 is connected to the other end of the pump passage 162, and the other end of the orifice passage 510, which is opposite from the pump passage 162, is opened in the interior of the canister port 140. Thus, the orifice passage 510 is always communicated with the canister port 140 and the pump passage 162. An orifice 520 is arranged in an intermediate portion of the orifice passage 510. An inner diameter of the orifice 520 corresponds to an opening diameter, which allows leakage of air that includes fuel vapor generated in the fuel tank 20.

A connector 180 is arranged in the pump receiving portion 120 of the housing 110. A terminal assembly 181 of the connector 180 is connected to a coupler (not shown), to which electric power is supplied from a power source (not shown) through the ECU 50. The terminal assembly 181 of the connector 180 includes a terminal 182, which is connected to the pressure sensor 400, and a terminal 183, which is connected to a coil assembly 332 of the switching valve 300. The terminal assembly 181 further includes a terminal (not shown), which is connected to a control circuit unit 280 of a motor arrangement 220 of the vane pump 200.

The vane pump 200 includes the pump arrangement 202, the motor arrangement 220, a protective member (a first end member) 240 and bolts (serving as a connecting means and also serving as male threaded screw members) 250.

Figure 1:
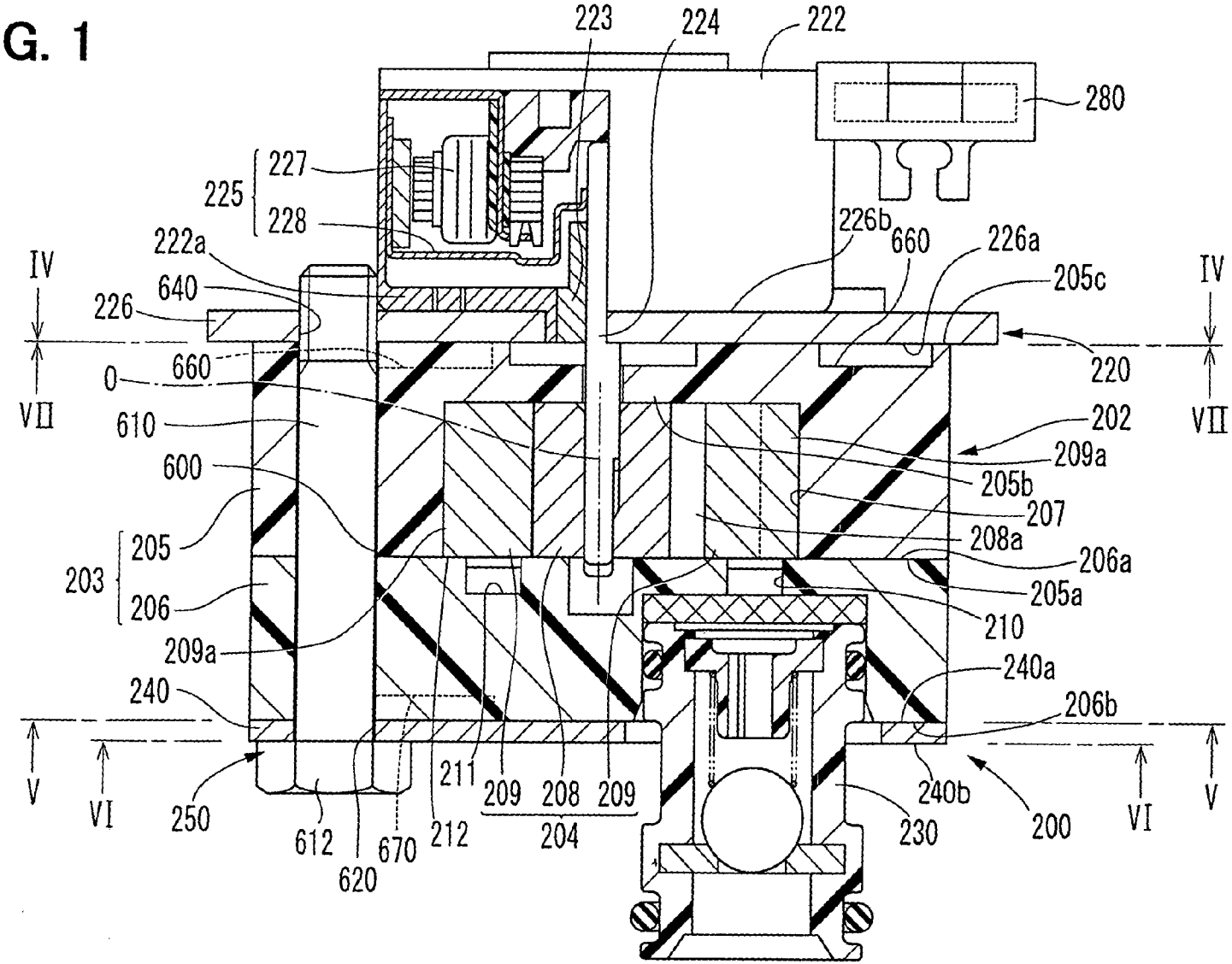
FIG. 1 is a cross sectional view of a vane pump according to a first embodiment of the present invention.

The pump arrangement 202 includes a casing 203, a rotor 204 and the check valve 230. The casing 203 is arranged in the pump receiving portion 120. As shown in FIG. 1, the casing 203 includes a cam ring 205 and a plate (serving as a cover member) 206, which are connected together to form the casing 203. The cam ring 205 is made of resin and has opposed first and second ends. The cam ring 205 has an opening 212 at the first end and a base wall **205*b* at the second end. A generally cylindrical pump chamber 207 is defined in the cam ring 205 and is communicated with the opening 212 of the cam ring 205. The plate 206 is made of resin and is formed as a thick flat plate. The plate 206 has opposed first and second ends. A second end surface 206*a* of the plate 206, which is located in the second end of the plate 206, makes flat surface contact with a first end surface 205*a* of the cam ring 205, which is located in the first end of the cam ring 205, so that the opening 212 of the cam ring 205 is covered by the plate 206. The rotor 204 is received in the pump chamber 207 and is located between the base wall 205*b* of the cam ring 205 and the plate 206. The rotor 204 includes a rotor shaft 208 and a plurality of vanes 209. The rotor shaft 208 is eccentric to a center of the pump chamber 207 and rotates about a central axis O thereof. Each vane 209 projects radially and is radially slidably received in a corresponding groove 208*a* of the rotor shaft 208. A radially outer edge 209*a* of each vane 209 slidably engages an inner peripheral wall of the cam ring 205 upon application of a centrifugal force generated by rotation of the rotor shaft 208**.

The plate 206 includes the intake opening 210 and the outlet opening 211 of the pump arrangement 202. The intake opening 210 opens in the first end surface **206*b* of the plate 206 and also opens in the second end surface 206*a* of the plate 206 at a position that is axially opposed to the pump chamber 207. The outlet opening 211 opens in an outer peripheral surface of the plate 206 and also opens in the second end surface 206*a* of the plate 206 at a position that is axially opposed to the pump chamber 207. The air, which is drawn into the pump chamber 207 through the intake opening 210 at the time of rotating the rotor 204, is compressed by the vanes 209 and is then discharged to the outlet passage 163 through the outlet opening 211. In this way, the pump arrangement 202 depressurizes the interior of the fuel tank 20 through the canister 30**.

The check valve 230 is inserted into the intake opening 210 from the first end surface 206*b* side of the intake opening 210, and a protruding end of the check valve 230, which protrudes from the intake opening 210, is connected to the pump passage 162. The check valve 230 is opened when the rotor 204 is rotated. The check valve 230 is closed when the rotor 204 is not rotated.

In this embodiment, the motor arrangement 220 is made as a contactless direct current brushless motor. The motor arrangement 220 includes a case member 222, a bearing 223, a rotatable shaft 224, an electric drive unit 225, the control circuit unit 280 and a mount (a second end member) 226. The case member 222 is made of metal and is formed into a box shape. The case member 222 is received in the pump receiving portion 120. The case member 222 receives the bearing 223 and the electric drive unit 225. The bearing 223 rotatably receives one end of the rotatable shaft 224 while substantially preventing radial movement of the rotatable shaft 224. The other end of the rotatable shaft 224 penetrates through the base wall 205*b* of the cam ring 205 and is securely connected to the rotor shaft 208 in a coaxial manner in the pump chamber 207. The electric drive unit 225 shifts the energization position of a coil assembly 227, so that a rotator 228, which is coaxially installed to the rotatable shaft 224, is rotated by the electric drive unit 225. The control circuit unit 280 is arranged outside of the case member 222 and is connected to the coil assembly 227 of the electric drive unit 225. Through control of the energization position of the coil assembly 227 by the control circuit unit 280, the rotatable shaft 224, which is connected to the rotator 228, is rotated at a predetermined rpm, so that the rotor 204, which is connected to the rotatable shaft 224, is also rotated at a predetermined rpm. The mount 226 is made of metal and is formed as a thin flat plate. The mount 226 has opposed first and second end surfaces 226*a*, 226*b* and is secured to a base wall 222*a* of the case member 222 at the second end surface 226*b*. The first end surface 226*a* of the mount 226 makes flat surface contact with a second end surface 205*c* of the cam ring 205, which is located in the second end of the cam ring 205 where the base wall 205*b* is formed.

The protective member 240 is made of metal and is formed as a thin flat plate. The protective member 240 has opposed first and second end surfaces 240*b*, 240*a*. The second end surface 240*a* of the protective member 240 makes flat surface contact with the first end surface 206*b* of the plate 206. Thus, the protective member 240 is located at a first end of the casing 203. The cam ring 205 and the plate 206, which constitute the casing 203, are connected to the mount 226 together with the protective member 240 by the bolts 250. The bolts 250 exert a clamping force for clamping the casing 203 between the protective member 240 and the mount 226.

As shown in FIG. 3, the switching valve 300 includes a valve body 310, a closure valve 340, a reference valve 350, a valve shaft member 320 and an electromagnetic drive unit 330.

The valve body 310 is held in the switch valve receiving portion 130. The closure valve 340 includes a first valve seat 341 and a washer 342. The first valve seat 341 is made integrally in the valve body 310. The washer 342 is installed to an intermediate portion of the valve shaft member 320. The reference valve 350 include a second valve seat 351 and a valve cap 352. The second valve seat 351 is formed integrally in the switching valve receiving portion 130. The valve cap 352 is installed to one end of the valve shaft member 320 located on a canister 30 side of the valve shaft member 320. The valve shaft member 320 is driven by the electromagnetic drive unit 330. The electromagnetic drive unit 330 includes a spring 331, the coil assembly 332, a stationary core 333 and a movable core 334. The spring 331 urges the valve shaft member 320 against the second valve seat 351. The coil assembly 332 is connected to the ECU 50. Power supply to the coil assembly 332 is enabled or disabled by the ECU 50. Each of the stationary core 333 and the movable core 334 is made of a magnetic material. The stationary core 333 and the movable core 334 are opposed to each other in the axial direction of the valve shaft member 320. The movable core 334 is installed to the other end of the valve shaft member 320, which is opposite from the canister 30.

When electric current is not supplied to the coil assembly 332, a magnetic attractive force is not generated between the stationary core 333 and the movable core 334. Thus, the valve shaft member 320 is moved in a direction (a downward direction in FIG. 3) away from the stationary core 333 by the urging force of the spring 331, so that the valve cap 352 is seated against the second valve seat 351, and the washer 342 is lifted away from the first valve seat 341. In this way, the canister port 140 and the atmosphere port 150 are communicated to one another. Also, the communication of the pump passage 162 to the canister port 140 and to the atmosphere port 150 is disconnected in the path, which bypasses the orifice passage 510. When electric current is supplied to the coil assembly 332, a magnetic attractive force is generated between the stationary core 333 and the movable core 334. Thus, the valve shaft member 320 is moved against the urging force of the spring 331 in a direction (in an upward direction in FIG. 3) toward the stationary core 333, so that the valve cap 352 is lifted away from the second valve seat 351, and the washer 342 is seated against the first valve seat 341. In this way, the pump passage 162 and the canister port 140 are communicated to one another via the path, which bypasses the orifice passage 510, and the canister port 140 and the atmosphere port 150 are discommunicated from one another.

The pressure sensor 400 is arranged in the sensor chamber 170. The pressure sensor 400 measures a pressure in the sensor chamber 170 and outputs a signal, which corresponds to a measured pressure of the sensor chamber 170, to the ECU 50. The sensor chamber 170 communicates with the pump passage 162 through the pressure communicating passage 164. Thus, the pressure, which is measured by the pressure sensor 400, is substantially the same as a pressure in the pump passage 162.

As shown in FIG. 2, the canister 30 is connected to the fuel tank 20 through a tank passage 32. The canister 30 includes an adsorbent 31, such as active carbon. The fuel vapor, which is generated in the fuel tank 20, is adsorbed by the adsorbent 31 of the canister 30. Therefore, a concentration of fuel vapor, which is contained in the air discharged from the canister 30, becomes equal to or less than a predetermined value. The air intake apparatus 40 includes an air intake pipe 41, which is connected to an air intake system of the engine. A throttle valve 42 is arranged in the intake pipe 41 and adjusts a flow rate of intake air in the intake pipe 41. The air intake pipe 41 and the canister 30 are connected to one another through a purge passage 33. A purge valve 34 is arranged in the purge passage 33. The purge valve 34 opens and closes the purge passage 33 based on a command transmitted from the ECU 50.

The ECU 50 has a microcomputer, which includes a CPU, a ROM and a RAM (not shown). The ECU 50 controls the check module 100 and the various corresponding parts of the vehicle, in which the check module 100 is installed. Various signals are supplied to the ECU 50 from the pressure sensor 400 and also from sensors of the various corresponding parts of the vehicle. The ECU 50 controls the various corresponding parts of the vehicle based on the various signals upon execution of a predetermined control program, which is stored in the ROM. Operation of the motor arrangement 220 and operation the switching valve 300 are controlled by the ECU 50.

Next, a structure, which connects the casing 203 and the protective member 240 to the mount 226 in the vane pump 200, will be described.

Figure 4:
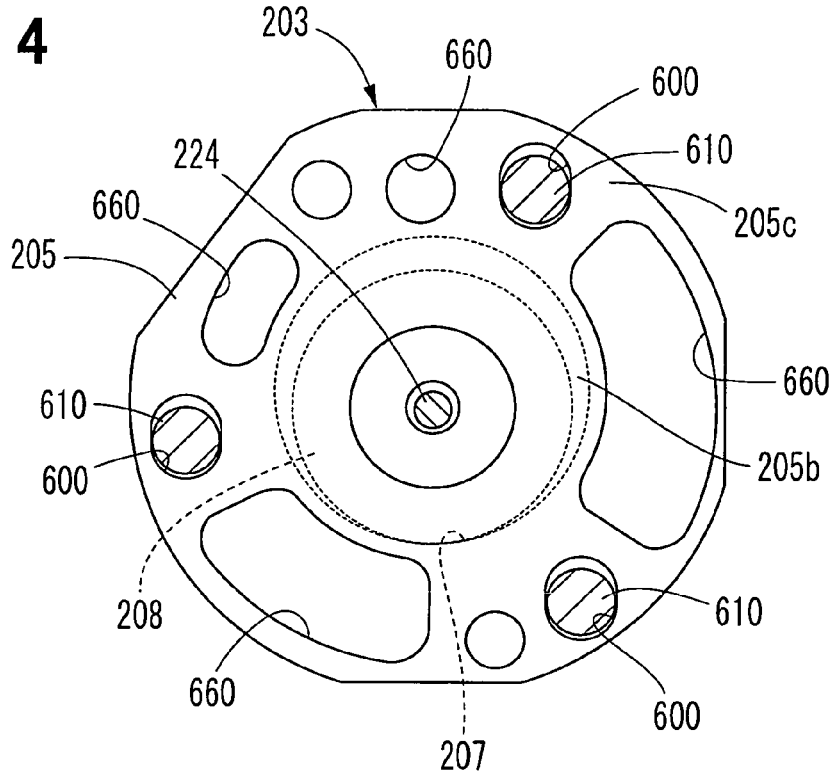
FIG. 4 is a cross sectional view along line IV-IV in FIG. 1.
Figure 5:
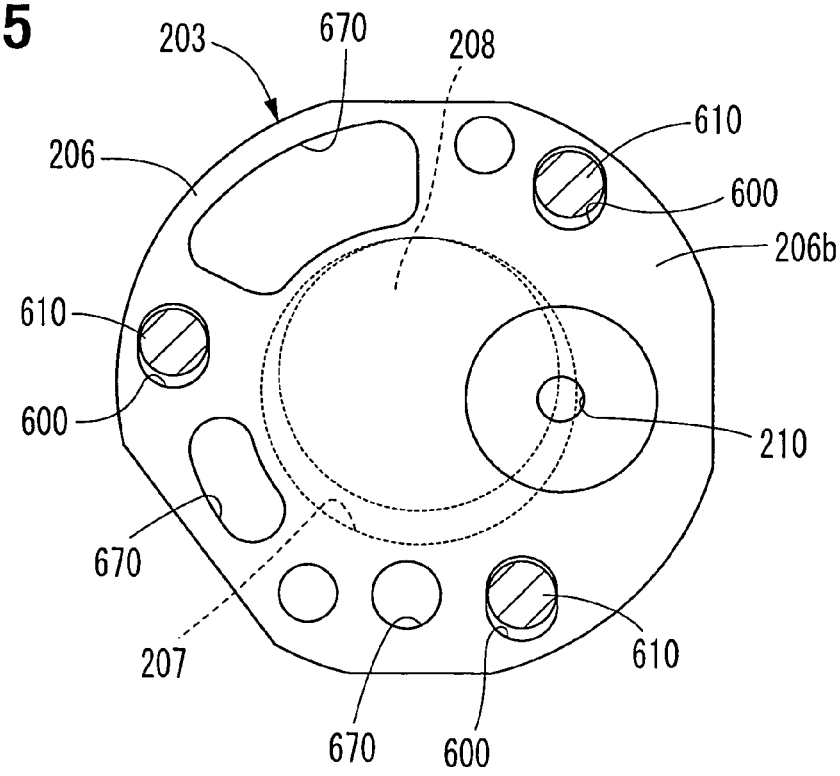
FIG. 5 is a cross sectional view along line V-V in FIG. 1.

As shown in FIGS. 1, 4 and 5, the casing 203 has three receiving through holes 600, each of which receives a shank 610 of the corresponding one of the bolts 250. The three receiving through holes 600 are arranged at generally equal angular intervals in the circumferential direction of the rotor shaft 208 and extend through the two constituent members 205, 206, which constitute the casing 203. Each receiving through hole 600 extends through the casing 203 in a direction parallel to the central axis O of the rotor shaft 208 at radially outward of the pump chamber 207.

Figure 6:
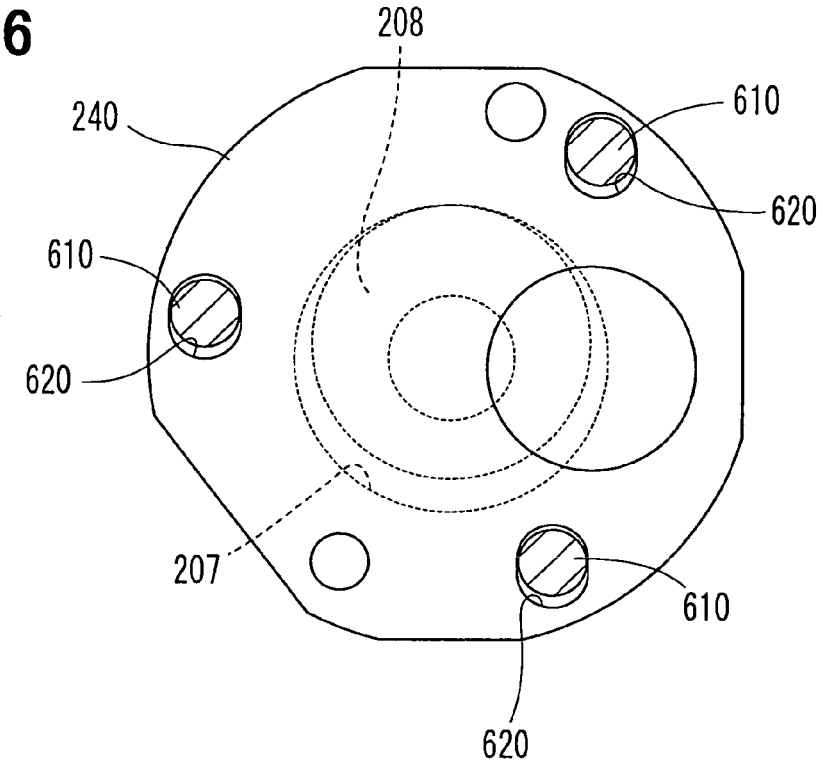
FIG. 6 is a cross sectional view along line VI-VI in FIG. 1.

As shown in FIGS. 1 and 6, the protective member 240 has three receiving through holes 620, each of which receives the shank 610 of a corresponding one of bolts 250. In the protective member 240, the three receiving through holes 620 are arranged at generally equal angular intervals and are aligned with the three receiving through holes 600, respectively, of the casing 203. Each receiving through hole 620 extends through the protective member 240 in a thickness direction of the protective member 240, which is parallel to the central axis O of the rotor shaft 208.

Figure 7:
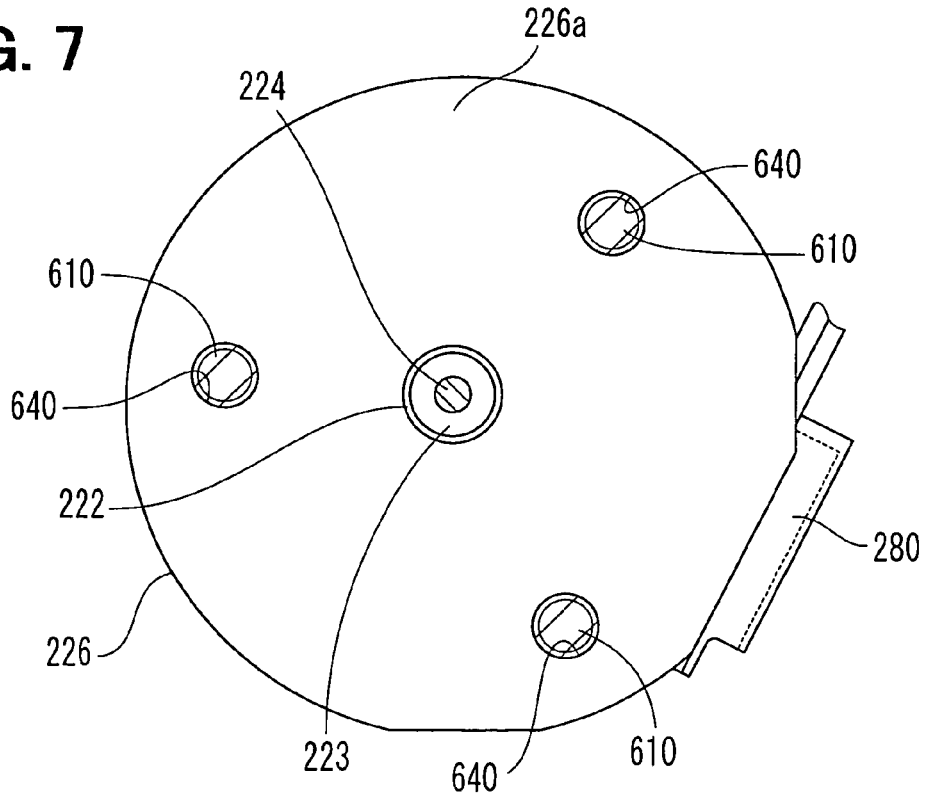
FIG. 7 is a cross sectional view along line VII-VII in FIG. 1.

As shown in FIGS. 1 and 7, the mount 226 has three female threaded holes 640, each of which is threadably engaged with the shank 610 of a corresponding one of the bolts 250. In the mount 226, the three female threaded holes 640 are arranged at generally equal angular intervals and are aligned with the three receiving through holes 600, respectively, of the casing 203. Each female threaded hole 640 extends through the mount 226 in a thickness direction of the mount 226, which is parallel to the central axis O of the rotor shaft 208.

As shown in FIG. 4, the casing 203 includes four relief recesses (second end side recesses) 660 in the second end surface 205*c* of the cam ring 205, which contacts the mount 226. Each recess 660 is recessed in the second end surface 205*c* of the cam ring 205 in such a manner that an opening of the recess 660 exists in the second end surface 205*c*. Each recess 660 is arranged between corresponding adjacent two of the receiving through holes 600 in the circumferential direction of the rotor shaft 208 in such a manner that the recess 660 is spaced away from all of the receiving through holes 600. With this arrangement, each recess 660 does not overlap with the pump chamber 207 in the axial direction of the rotor shaft 208.

As shown in FIG. 5, the casing 203 further includes three relief recesses (first end side recesses) 670 in the first end surface 206*b* of the plate 206, which contacts the protective member 240. Each recess 670 is recessed in the first end surface 206*b* of the plate 206 in such a manner that an opening of the recess 670 exists in the first end surface 206*b*. Similar to the recesses 660, each recess 670 is arranged between corresponding adjacent two of the receiving through holes 600 in the circumferential direction of the rotor shaft 208 in such a manner that the recess 670 is spaced away from all of the receiving through holes 600. With this arrangement, each recess 670 does not overlap with the pump chamber 207 in the axial direction of the rotor shaft 208.

As shown in FIG. 1, the shank 610 of each bolt 250 is generally parallel to central axis O of the rotor shaft 208 and is inserted from the first end surface 240*b* of the protective member 240 through the corresponding receiving through hole 620 of the protective member 240 and the corresponding receiving through hole 600 of the casing 203, and a distal end of the shank 610 is threadably engaged with the corresponding female threaded hole 640 of the mount 226. In the state of FIG. 1 where the bolts 250 are tightened, the protective member 240 and the casing 203 are securely connected to the mount 226 in such a manner that the protective member 240 and the casing 203 are held between a head 612 of each bolt 250 and the mount 226.

Next, operation of the check module 100 of the check system 10 will be described.

A check operation is not performed through the check module 100 until a predetermined time period elapses from the time of stopping the engine, which is installed in the vehicle. Thus, before the check operation, electric current is not supplied to the coil assembly 332 of the switching valve 300. Therefore, the canister port 140 and the atmosphere port 150 are communicated to one another. As a result, the air, which includes fuel vapor generated in the fuel tank 20, passes through the canister 30, in which the fuel vapor is removed from the air. Then, the air, from which the fuel vapor is removed by the canister 30, is released to the atmosphere through the open end 153 of the atmosphere passage 151.

(1) When the predetermined time period elapses from the time of stopping the engine, an atmospheric pressure is measured through the pressure sensor 400 before checking the air leakage. At this time, electric current is not supplied to the coil assembly 332 of the switching valve 300, and the atmosphere port 150 is communicated to the pump passage 162 through the canister port 140 and the orifice passage 510. Thus, the pressure, which is measured by the pressure sensor 400 arranged in the sensor chamber 170 that is communicated with the pump passage 162, becomes substantially the same as the atmospheric pressure. At this time, electric current is supplied only to the pressure sensor 400, and supply of electric current to the motor arrangement 220 and to the switching valve 300 is stopped. This state will be referred to as an atmospheric pressure sensing period or an atmospheric pressure sensing state A, as shown in FIG. 8.

(2) When the measurement of the atmospheric pressure is completed, an altitude of a location, at which the vehicle is currently stopped, is computed by the ECU 50 based on the measured atmospheric pressure. When the computation of the altitude is completed, supply of electric current to the coil assembly 332 of the switching valve 300 is initiated. Thus, the state is changed to a fuel vapor generation sensing state B shown in FIG. 8. When the electric current is supplied to the coil assembly 332 of the switching valve 300, the washer 342 is seated against the first valve seat 341, and the valve cap 352 is lifted away from the second valve seat 351. Thus, the communication between the atmosphere port 150 and the pump passage 162 is disconnected, and communication between the canister port 140 and the pump passage 162 is established via the path, which bypasses the orifice passage 510. As a result, the pump passage 162 is communicated with the fuel tank 20 through the canister 30, which is connected to the canister port 140. When fuel vapor is generated in the interior of the fuel tank 20, the pressure in the interior of the fuel tank 20 (i.e., the pressure of the fuel tank 20) becomes higher than the pressure (the atmospheric pressure) of a surrounding area around the vehicle, and the pressure, which is measured by the pressure sensor 400, is increased, as shown in FIG. 8.

Figure 8:
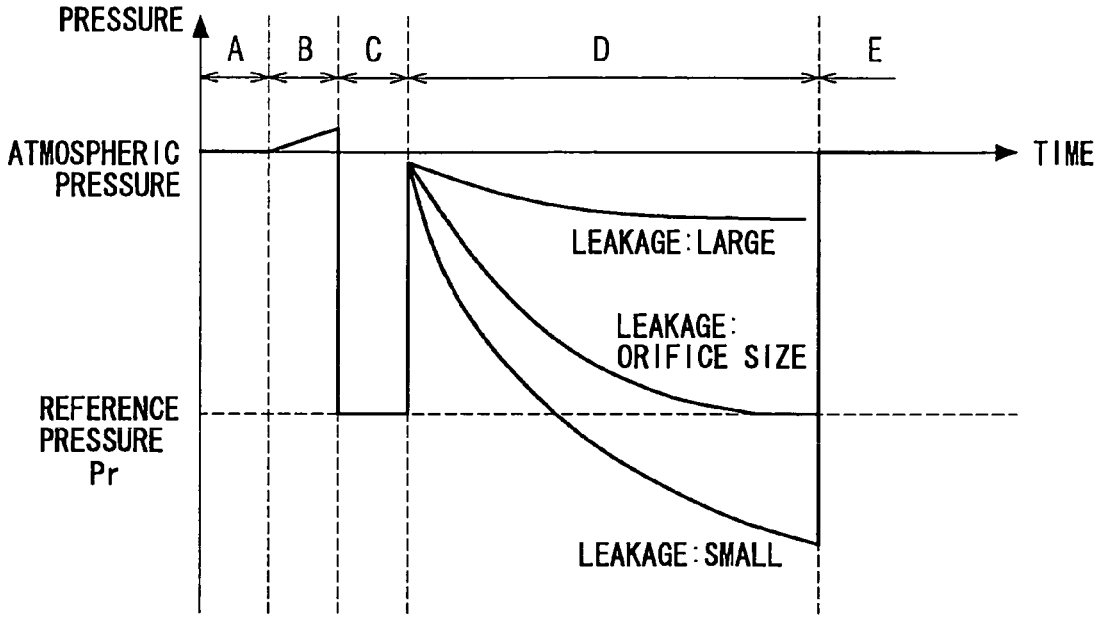
FIG. 8 is a graph showing a change in a pressure measured by a pressure sensor of the check module of the first embodiment with respect to time.

(3) When an increase in the pressure of the fuel tank 20 is sensed, supply of electric current to the coil assembly 332 of the switching valve 300 is stopped, and the state is changed to a reference pressure sensing state C shown in FIG. 8. When the supply of electric current to the coil assembly 332 is stopped, the washer 342 is lifted away from the first valve seat 341, and the valve cap 352 is seated against the second valve seat 351. Therefore, the canister port 140 and the atmosphere port 150 are communicated to one another, and the pump passage 162 is communicated with the canister port 140 and the atmosphere port 150 through the orifice passage 510. Thereafter, when supply of electric current to the coil assembly 227 of the motor arrangement 220 is initiated, the rotor 204 of the pump arrangement 202 is rotated. Thus, the check valve 230 is opened, and the pump passage 162 is depressurized. When the pump passage 162 is depressurized, the air, which is supplied from the atmosphere port 150 to the canister port 140, is supplied to the pump passage 162 through the orifice passage 510. Also, the air, which is supplied from the canister 30 to the canister port 140 and includes the fuel vapor, is supplied to the pump passage 162 through the orifice passage 510. The air, which is supplied to the pump passage 162, is throttled by the orifice 520 arranged in the orifice passage 510. Thus, as shown in FIG. 8, the pressure of the pump passage 162 drops. As discussed above, the inner diameter (an orifice size) of the orifice 520 is set to the predetermined size. Therefore, the pressure of the pump passage 162 drops to a predetermined pressure and is kept at the predetermined pressure. At this time, the pressure of the pump passage 162, which is measured by the pressure sensor 400, is stored as a reference pressure Pr in the RAM of the ECU 50. When the measurement of the reference pressure Pr is completed, supply of electric current to the motor arrangement 220 is stopped.

(4) When the measurement of the reference pressure Pr is completed, electric current is supplied to the coil assembly 332 of the switching valve 300. Thus, the state is changed to a depressurized state D shown in FIG. 8. When the electric current is supplied to the coil assembly 332 of the switching valve 300, the communication between the atmosphere port 150 and the pump passage 162 is disconnected, and communication between the canister port 140 and the pump passage 162 is achieved via the path, which bypasses the orifice passage 510. When the canister port 140 and the pump passage 162 are communicated to one another, the fuel tank 20 is communicated to the pump passage 162. Thus, the pressure of the fuel tank 20 substantially coincides with the pressure of the pump passage 162, and the pressure of the pump passage 162 is increased once again. When electric current is supplied to the coil assembly 227 of the motor arrangement 220, the rotor 204 of the pump arrangement 202 is rotated, and the check valve 230 is opened. Due to the rotation of the rotor 204, the interior of the fuel tank 20, which is communicated with the pump passage 162, is depressurized with time, as shown in FIG. 8.

When the pressure of the pump passage 162, i.e., the pressure of the fuel tank 20 decreases below the reference pressure Pr during the rotation of the rotor 204, it is determined that leakage of the air, which includes the fuel vapor, from the fuel tank 20 is within an allowable range. When the pressure of the fuel tank 20 decreases below the reference pressure Pr, air intrusion from the outside into the fuel tank 20 does not exist, or the air, which intrudes from the outside into the fuel tank 20, is equal to or below a flow rate of the air, which passes through the orifice 520. Thus, it is determined that the sufficient airtightness of the fuel tank 20 is achieved. In contrast, when the pressure of the fuel tank 20 does not decrease to the reference pressure Pr, it is assumed that the air leakage from the fuel tank 20 exceeds the allowable range. When the pressure of the fuel tank 20 does not decrease to the reference pressure Pr, it is assumed that the air is introduced into the fuel tank 20 at the time of depressurization of the interior of the fuel tank 20. Thus, it is assumed that the sufficient airtightness of the fuel tank 20 is not achieved. In the case where the sufficient airtightness of the fuel tank 20 is not achieved, when the fuel vapor is generated in the fuel tank 20, the air, which includes the fuel vapor, is released outside the fuel tank 20. When it is determined that the air leakage from the fuel tank 20 exceeds the allowable range, the ECU 50 lights a warning lamp (not shown) installed in a dashboard of the vehicle at the next operation of the engine. In this way, the leakage of the air, which includes the fuel vapor, from the fuel tank 20 is notified to the driver. When the pressure of the fuel tank 20 is substantially the same as the reference pressure Pr, the air leakage, which corresponds to the air flow rate of the orifice 520, exists at the fuel tank 20.

(5) When the check of air leakage is completed, the supply of electric current to the motor arrangement 220 and the switching valve 300 is stopped, and the state is changed to a determination complete state E shown in FIG. 8. The ECU 50 stops the supply of electric current to the pressure sensor 400 after the ECU 50 confirms that the pressure of the pump passage 162 is returned to the atmospheric pressure in a manner shown in FIG. 8. Thus, the ECU 50 ends the entire check process.

In the above first embodiment, the recesses 660 are formed in the second end surface 205*c* of the cam ring 205, which makes the flat surface contact with the mount 226, in such a manner that the recesses 660 are spaced away from the receiving through holes 600. Thus, the recessed portions of the second end surface 205*c*, in which the recesses 660 are formed, do not protrude beyond the adjacent portions of the second end surface 205*c*, which are adjacent to the receiving through holes 600, respectively, and which have no recess 660. In this way, tight contact can be made between the cam ring 205 and the mount 226 around the bolts 250, which are received through the receiving through holes 600. When the cam ring 205 and the mount 226 tightly contact to one another, sufficient connecting force is achieved by the bolts 250 to securely connect between the casing 203 and the mount 226. When the sufficient connecting force is achieved between the casing 203 and the mount 226, the motor arrangement 220 is less likely vibrated relative to the casing 203 during the operation of the vane pump 200. Thus, the accidental change in the pump flow rate of the pump arrangement 202 is limited. Therefore, the pump flow rate of the pump arrangement 202 is stabilized in the operations of the check module 100 described in the above sections (3) and (4). As a result, the performance of the check module 100 is improved.

Furthermore, in the first embodiment, the metal mount 226 is used. Thus, wearing of the female threaded holes 640, which threadably receive the bolts 250, respectively, can be advantageously limited. Also, since the cam ring 205 and the plate 206 of the casing 203 are made of resin, the recesses 660, 670 can be easily formed in the cam ring 205 and the plate 206, and the total weight of the vane pump 200 and therefore the total weight of the check module 100 can be reduced. Furthermore, since the protective member 240 is provided to the first end surface 206*b* of the casing 203, which is opposite from the mount 226, the heads 612 of the bolts 250 contact the protective member 240 rather than the plate 206. Since the protective member 240 is made of the metal, the protective member 240 is less likely deformed when the heads 612 of the bolts 250 are urged against the protective member 240 upon tightening of the bolts 250.

Furthermore, in the first embodiment, the recesses 670 are formed in the first end surface 206*b* of the plate 206, which makes the flat surface contact with the protective member 240, in such a manner that the recesses 670 are spaced away from the receiving through holes 600. Thus, the recessed portions of the first end surface 206*b*, in which the recesses 670 are formed, do not protrude beyond the adjacent portions of the first end surface 206*b*, which are adjacent to the receiving through holes 600, respectively, and which have no recess 670. In this way, tight contact can be made between the plate 206 and the protective member 240 around the bolts 250, which are received through the receiving through holes 600. Thus, it is possible to limit the accidental change in the pump flow rate of the pump arrangement 202, which could happen when the connecting force that connects between the protective member 240 and the casing 203 is decreased in the case where the protective member 240 and the casing 203 are connected together by the bolts 250.

Furthermore, in the first embodiment, absorption of water vapor or fuel vapor, which is contained in the air supplied to the pump chamber 207, and/or a change in the surrounding temperature may cause expansion/compression of the resin cam ring 205 and the resin plate 206. However, in a boundary between the cam ring 205 and the mount 226, which make the tight contact therebetween around the bolts 250 due to the presence of the recesses 660, a contact pressure can be kept high by a relatively small axial force of the bolts 250. Also, in a boundary between the plate 206 and the protective member 240, which make the tight contact therebetween around the bolts 250 due to the presence of the recesses 670, a contact pressure can be kept high by the relatively small axial force of the bolts 250. When the contact pressures are kept height in these boundaries, it is possible to limit a reduction in the connecting force between the casing 203 and the mount 226 caused by the expansion/compression of the cam ring 205 and the plate 206.

Furthermore, according to the first embodiment, the casing 203 is formed in such a manner that the recesses 660, 670 do not overlap with the pump chamber 207 in the axial direction of the rotor shaft 208. Thus, it is not required to increase the thickness of the casing 203 to form the recesses 660, 670. Therefore, the size of the vane pump 200 and therefore the size of the check module 100 are not increased.

SECOND EMBODIMENT

Figure 9:
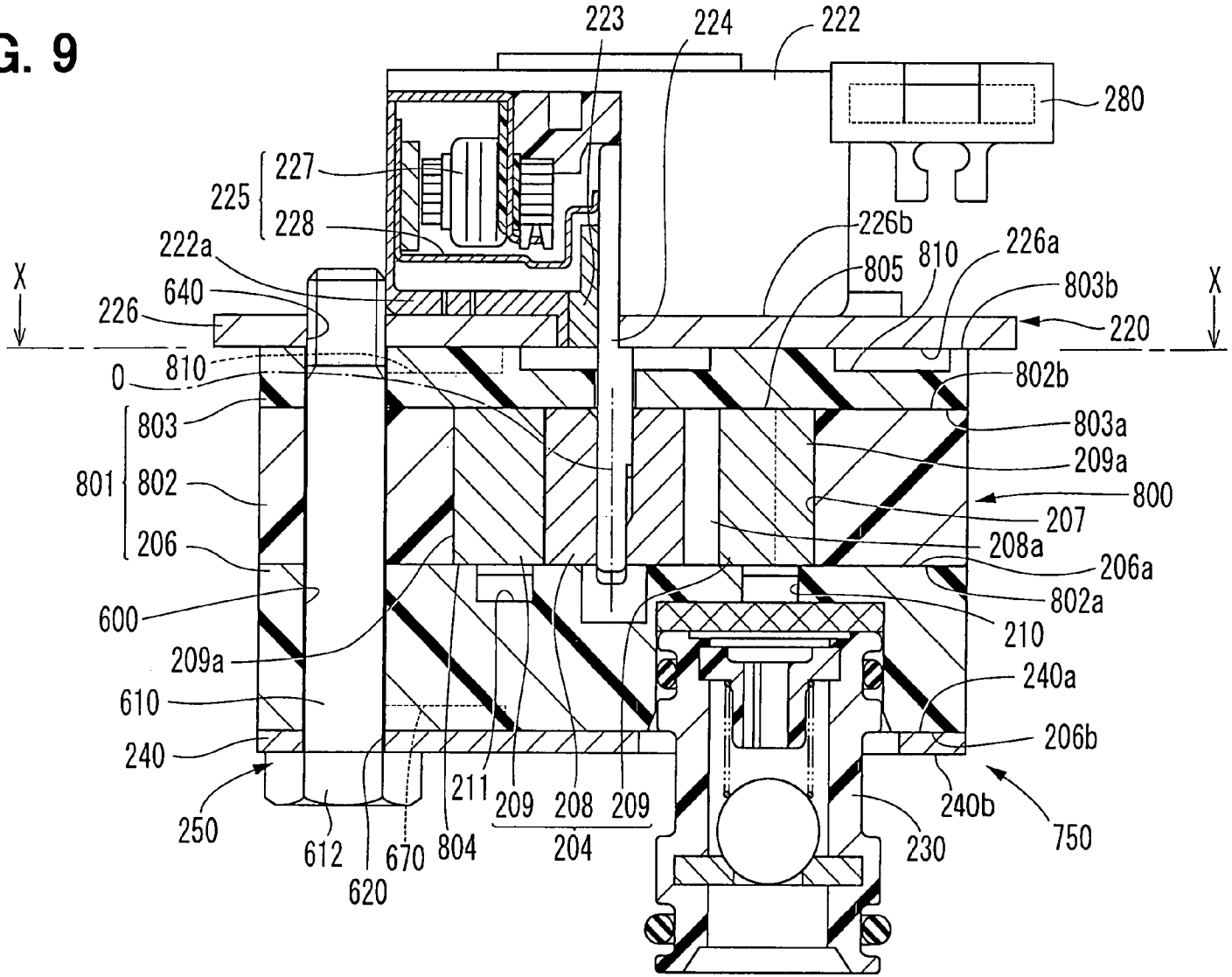
FIG. 9 is a cross sectional view of a vane pump according to a second embodiment of the present invention.

A second embodiment of the present invention will be described with reference to FIGS. 9 and 10. Components similar to those discussed in the first embodiment will be indicated by the same numerals and will not be described further. The following discussion is mainly focused on the dissimilar points, which differ from the first embodiment. FIG. 9 shows a vane pump 750 of the second embodiment.

A casing 801 of a pump arrangement 800 of the vane pump 750 includes a cam ring 802, a first plate (a first cover member) 206 and a second plate (a second cover member) 803. The cam ring 802 is made of resin and is formed into a tubular body. The cam ring 802 includes opposed first and second openings 804, 805 in its first and second end surfaces 802*a*, 802*b* respectively, and defines a pump chamber 207 therein. The first opening 804 of the cam ring 802 is covered by the first plate 206 in such a manner that a second end surface 206*a* of the first plate 206, which is opposite from the protective member 240, makes flat surface contact with the first end surface 802*a* of the cam ring 802, in which the first end opening 804 is formed. The second plate 803 is made of resin and is formed as a thick flat plate. The second opening 805 of the cam ring 802 is covered by the second plate 803 in such a manner that a first end surface 803*a* of the second plate 803 makes flat surface contact with the second end surface 802*b* of the cam ring 802, in which the second opening 805 is formed.

Similar to the first embodiment, the three receiving through holes 600 penetrate through the three constituent members 802, 206, 803, which constitute the casing 801. The three constituent members 802, 206, 803 are connected to the mount 226 by the bolts 250 in such a manner that the three constituent members 802, 206, 803 are held together by the bolts 250, which are inserted through the receiving through holes 600, respectively. In this way, the second end surface 803*b* of the second plate 803, which is opposite from the cam ring 802, makes flat surface contact with the first end surface 226*a* of the mount 226. Furthermore, the other end of the rotatable shaft 224, which is opposite from the bearing 223, penetrates through the second plate 803 and is securely connected to the rotor shaft 208 of the rotor 204 arranged between the first plate 206 and the second plate 803.

Figure 10:
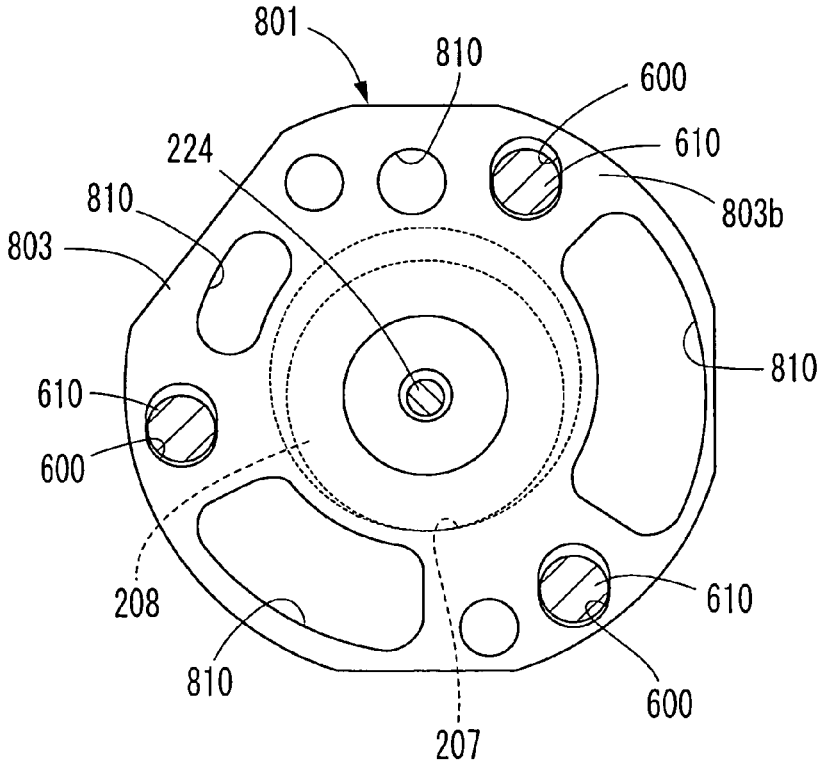
FIG. 10 is a cross sectional view along line X-X in FIG. 9.

As shown in FIGS. 9 and 10, the casing 801 includes four relief recesses 810 in the second end surface 803*b* of the second plate 803, which contacts the mount 226. Each recess 810 is recessed in the second end surface 803*b* of the second plate 803 in such a manner that an opening of the recess 810 exists in the second end surface 803*b*. Each recess 810 is arranged between corresponding adjacent two of the receiving through holes 600 in the circumferential direction of the rotor shaft 208 in such a manner that the recess 810 is spaced away from all of the receiving through holes 600. With this arrangement, each recess 810 does not overlap with the pump chamber 207 in the axial direction of the rotor shaft 208.

Similar to the first embodiment, the casing 801 includes three relief recesses 670 in the first end surface 206*b* of the first plate 206, which contacts the protective member 240.

In the second embodiment, the recesses 810 are formed in the second end surface 803*b* of the second plate 803, which makes the flat surface contact with the mount 226, in such a manner that the recesses 810 are spaced away from the receiving through holes 600. Thus, similar to the first embodiment, sufficient connecting force is achieved by the bolts 250 to securely connect between the casing 801 and the mount 226. Therefore, when the vane pump 750 is operated, the motor arrangement 220 is less likely vibrated relative to the casing 801. Thus, the accidental change in the pump flow rate of the pump arrangement 800 is limited.

Furthermore, in the second embodiment, since the second plate 803 is made of resin, the recesses 810 can be easily formed in the second plate 803, and the weight of the vane pump 750 can be reduced.

In the second embodiment, in the boundary between the second plate 803 and the mount 226, which tightly contact to one another around the bolts 250 due to the presence of the recesses 810, a contact pressure can be kept high by the relatively small axial force of the bolts 250. Thus, it is possible to limit a reduction in the connecting force between the casing 801 and the mount 226 caused by the expansion/compression of the plate 803.

Furthermore, in the second embodiment, the recesses 810 are formed in such a manner that the recesses 810 do not overlap with the pump chamber 207 in the axial direction of the rotor shaft 208. Thus, it is not required to increase the thickness of the casing 801. As a result, an increase in the size of the vane pump 750 can be limited.

In the first and second embodiments, the casing 203, 801 is made of resin, and the bolts 250 are used to clamp the casing 203, 801 between the protective member 240 and the mount 226. In such a case, creep cannot be ignored. When a clamping force applied from the bolts 250 to the casing 203, 801 is too small, a sufficient residual stress cannot be maintained in the casing 203, 801 for a long period of time due to the creep. Some experimental results reveal that the residual stress becomes substantially zero after, for example, 15 years when the initial residual stress applied from the bolts to the previously proposed casing, which has no relief recess 660, 670, 810, is relatively small (e.g., 3.1 MPa). Furthermore, when the bolts are tightened excessively to increase the clamping force and thereby the initial stress applied to the casing, the bolts could be sheared or broken. However, in the first and second embodiments, due to the presence of the relief recesses 660, 670, 810 in the casing 203, 801, the initial residual force can be increased without increasing the clamping force applied from the bolts to the casing 203, 801. In the case of the vane pump 200, 750, there is no liquid seal (e.g., oil seal). Thus, the vane pump 200, 750 is sensitive to the leakage. Furthermore, in order to stabilize the pump performance, substantial radial positional deviation of the components of the vane pump 200, 750 needs to be effectively limited. Because of the increased residual stress in the casing 203, 801 of the first and second embodiments, it is possible to improve the sealing performance of the vane pump 200, 750 and to limit the radial positional deviation of the components of the vane pump 200, 750 even after a long period of time.

In the first and second embodiments, the present invention is embodied in the check system, which checks air leakage through depressurization of the interior of the fuel tank. However, it should be noted that the present invention is equally applicable to a check system, which checks air leakage through pressurization of the interior of the fuel tank. Also, the present invention is equally applicable to various known system, which depressurizes or pressurizes fluid.

Additional advantages and modifications will readily occur to those skilled in the art. The invention in its broader terms is therefore not limited to the specific details, representative apparatus, and illustrative examples shown and described.

What is claimed is:

1. A vane pump comprising:

a motor arrangement that includes a mount;

a rotor that includes a plurality of vanes and is rotated by the motor arrangement;

a casing that has first and second end surfaces at respective longitudinal ends thereof, said second end surface making flat surface contact with the mount, wherein the casing includes:

a pump chamber, which receives the rotor;

at least one receiving through hole, which longitudinally penetrates through the casing; and at least one second end side recess, which is recessed in the second end surface of the casing, wherein the at least one second end side recess is laterally spaced away from the at least one receiving through hole; and at least one male threaded screw member, each of which is received through a corresponding one of the at least one receiving through hole of the casing and each of which is threadably engaged with the mount to connect the casing to the mount.

2. The vane pump according to claim 1, wherein the at least one second end side recess of the casing does not overlap with the pump chamber of the casing in an axial direction of the rotor.

3. The vane pump according to claim 1, wherein the casing includes:

a cam ring that has an opening at a first longitudinal end of the cam ring and a base wall at a second longitudinal end of the cam ring that is opposite from the first longitudinal end of the cam ring, wherein the pump chamber is defined in the cam ring and is communicated with the opening of the cam ring; and a cover member that covers the opening of the cam ring.

4. The vane pump according to claim 1, wherein the casing includes:

a cam ring that has first and second openings at opposed first and second longitudinal ends, respectively, of the cam ring, wherein the pump chamber is defined in the cam ring and is communicated with both the first and second openings of the cam ring;

a first cover member that covers the first opening of the cam ring; and a second cover member that covers the second opening of the cam ring.

5. The vane pump according to claim 1, wherein the mount is made of metal, and the casing is made of resin.

6. The vane pump according to claim 5, further comprising a protective member, which is made of metal and is connected to the first end surface of the casing by the at least one male threaded screw member.

7. The vane pump according to claim 6, wherein:

the protective member makes flat surface contact with the first end surface of the casing; and the casing further includes at least one first end side recess, which is recessed in the first end surface of the casing, wherein the at least one first end side recess is spaced away from the at least one receiving through hole.

8. A vane pump comprising:

a rotor that includes a plurality of vanes;

a casing that has first and second end surfaces at respective longitudinal ends thereof and includes:

a pump chamber, which rotatably receives the rotor; and at least one recess recessed in at least one of the first and second end surfaces of the casing;

a first end member that covers the first end surface of the casing;

a second end member that covers the second end surface of the casing; and a connecting means for connecting the first end member, the casing and the second end member together and for exerting a clamping force for clamping the casing between the first end member and the second end member, wherein the connecting means is laterally spaced away from the at least one recess.

9. The vane pump according to claim 8, wherein:

the first end member is made of metal;

the second end member is made of metal; and the casing is made of resin.

10. The vane pump according to claim 8, wherein said connecting means includes at least one male threaded screw member, which penetrate through the first end member, the casing and the second end member.

11. The vane pump according to claim 10, wherein:

said at least one recess includes at least three recesses, which are recessed in one of the first and second end surfaces of the casing radially outward of the pump chamber;

said at least one male threaded screw member includes at least three male threaded screw members which are arranged at generally equal angular intervals; and each adjacent two of the at least three male threaded screw members are arranged to have at least one of the at least three recesses therebetween.

12. A fuel vapor leakage check module for checking leakage of fuel vapor from a fuel tank, the fuel vapor leakage check module comprising a vane pump, wherein the fuel vapor leakage check module checks leakage of fuel vapor from the fuel tank through depressurization or pressurization of an interior of the fuel tank by the vane pump, and the vane pump includes:

a motor arrangement that includes a mount;

a rotor that includes a plurality of vanes and is rotated by the motor arrangement;

a casing that has first and second end surfaces at respective longiitudinal ends thereof, said second end surface making flat surface contact with the mount, wherein the casing includes:

a pump chamber, which receives the rotor;

at least one receiving through hole, which penetrates through the casing; and at least one second end side recess, which is recessed in the second end surface of the casing, wherein the at least one second end side recess is laterally spaced away from the at least one receiving through hole; and at least one male threaded screw member, each of which is received through a corresponding one of the at least one receiving through hole of the casing and each of which is threadably engaged with the mount to connect the casing to the mount.

* * * * *